US007066864B2

(12) United States Patent
Olkkonen

(10) Patent No.: US 7,066,864 B2
(45) Date of Patent: Jun. 27, 2006

(54) POLE

(75) Inventor: Kari Olkkonen, Tuusula (FI)

(73) Assignee: Exel Oyj (FI)

( * ) Notice: Subject to any disclaimer, the term of this patent is extended or adjusted under 35 U.S.C. 154(b) by 105 days.

(21) Appl. No.: 10/481,956

(22) PCT Filed: Jun. 28, 2002

(86) PCT No.: PCT/FI02/00576

§ 371 (c)(1),
(2), (4) Date: Sep. 8, 2004

(87) PCT Pub. No.: WO03/002218

PCT Pub. Date: Jan. 9, 2003

(65) Prior Publication Data

US 2005/0014607 A1 Jan. 20, 2005

(51) Int. Cl.
*A63B 21/00* (2006.01)

(52) U.S. Cl. ..... 482/1; 482/8; 135/65

(58) Field of Classification Search ..... 482/1–9, 482/900–902; 340/500, 686.1; 135/65–86
See application file for complete search history.

(56) References Cited

U.S. PATENT DOCUMENTS

| | | | | |
|---|---|---|---|---|
| 1,841,951 | A | 1/1932 | Hopper | |
| 5,097,856 | A * | 3/1992 | Chi-Sheng | 135/72 |
| 5,471,405 | A | 11/1995 | Marsh | |
| 6,011,481 | A * | 1/2000 | Luther et al. | 340/686.1 |
| 6,266,623 | B1 | 7/2001 | Vock et al. | |
| 6,668,846 | B1 * | 12/2003 | Meador | 135/65 |

FOREIGN PATENT DOCUMENTS

| | | | |
|---|---|---|---|
| AU | 56751/86 | A | 10/1986 |
| DE | 8 620 394 | U1 | 1/1987 |
| EP | 1 040 811 | A2 | 10/2000 |
| FR | 2 638 340 | A1 | 5/1990 |
| SU | 1732981 | A1 | 5/1992 |
| WO | WO 0166196 | A2 | 9/2001 |

* cited by examiner

*Primary Examiner*—Glenn E. Richman
(74) *Attorney, Agent, or Firm*—Rothwell, Figg, Ernst & Manbeck, PC

(57) ABSTRACT

The invention relates to a walking or ski pole used in Nordic walking or skiing. To a prior art pole including a body part (1), a grip part (2), and a tip part (3), is connected a power sensor (6), a user interface (7), and a transmitting device (9) for transmitting the data from the power sensor to the user interface for the purpose of measuring the physiological effect of the pole-assisted exercise and for controlling the exercise performance.

8 Claims, 4 Drawing Sheets

POLE

CROSS-REFERENCE TO RELATED APPLICATION

This application is a §371 of PCT Application Ser. No. PCT/FI02/00576, filed Jun. 28, 2002.

BACKGROUND OF THE INVENTION

1. Field of the Invention

The invention relates to a walking or ski pole used in Nordic Walking or skiing, or a pole used for assistance in some other physical exercise performance, such as skating. More specifically, the object of the invention is a pole for measuring the physiological effect of pole-assisted exercise and for controlling the exercise performance.

2. Description of the Background Art

Nordic Walking was developed to replace or supplement traditional skiing as a form of exercise. As a pole it uses a pole modified from a conventional ski pole, which is shorter than a pole used in skiing. The shaft part may, however, be produced using the same methods and the same materials as with ski poles. The grip part of the walking pole is identical with a ski pole, but the lower part of the walking pole differs from a ski pole. A walking pole lacks a sharp steel spike, the purpose of which in a ski pole is to provide sufficient grip for the thrust motion on a slippery and even icy surface. Since pole exercise takes place mainly when the ground is unfrozen, or even in winter conditions often on surfaces cleaned of snow and gritted well, this type of spike is not necessarily required. It is, therefore, often replaced by a rounded and also slightly thickened end of rubber or plastic. In the vicinity of the end may be a widened section, the purpose of which is to prevent the pole from penetrating too deep into the ground, should the terrain for some reason be particularly soft. This part corresponds to the ring in a ski pole.

In summer, the aim of pole exercise is to strain the muscle groups of the upper body as in traditional or free-style cross-country skiing on snow. When skiing on snow, the function of the hands is to maintain the speed of the skier and to increase slide in joint action with the legs. The weak friction between the snow and the ski prevents the skier from advancing efficiently in a diagonal style without the assistance of the poles. The friction between the snow and the ski and the manner of moving automatically control the working of the upper body during a skiing performance.

In Nordic Walking, one moves normally by walking on a non-slip surface, whereby using the muscles of the upper body as a part of the exercise performance feels unnatural. For the majority of Nordic Walkers, performing long-lasting exercise with an even strain on the upper and lower body is extremely difficult. Adopting the correct style for exercising with poles is also difficult without instruction. The correct usage of a pole involves taking into account the starting and stopping points of the thrust, the duration of the working pace and the power of the thrust.

SUMMARY OF THE INVENTION

By means of the pole according to the invention is achieved improvement in the control of the effect of the exercise performance and of the correct manner of performance. This gives the exerciser necessary information on the exercise performance during and after the exercise, and thus makes possible better planning of target-oriented exercise.

The pole according to the invention provides the exerciser with real time information on the exercise during the performance of the exercise in the form of the duration of the walking pace, the frequency of the thrust force and the number of paces by measuring or assessing these parameters in an on-line state. The said parameters can, therefore, be monitored during the performance and alarm limits can be preset before the performance is started to provide the correct type of exercise.

To achieve this, the pole according to the invention is characterised by what is specified in the characterising part of the independent claims.

BRIEF DESCRIPTION OF THE DRAWINGS

The invention is described in greater detail in the following by means of examples, with reference to the accompanying drawings, in which.

DETAILED DESCRIPTION OF THE INVENTION

Figure 1:
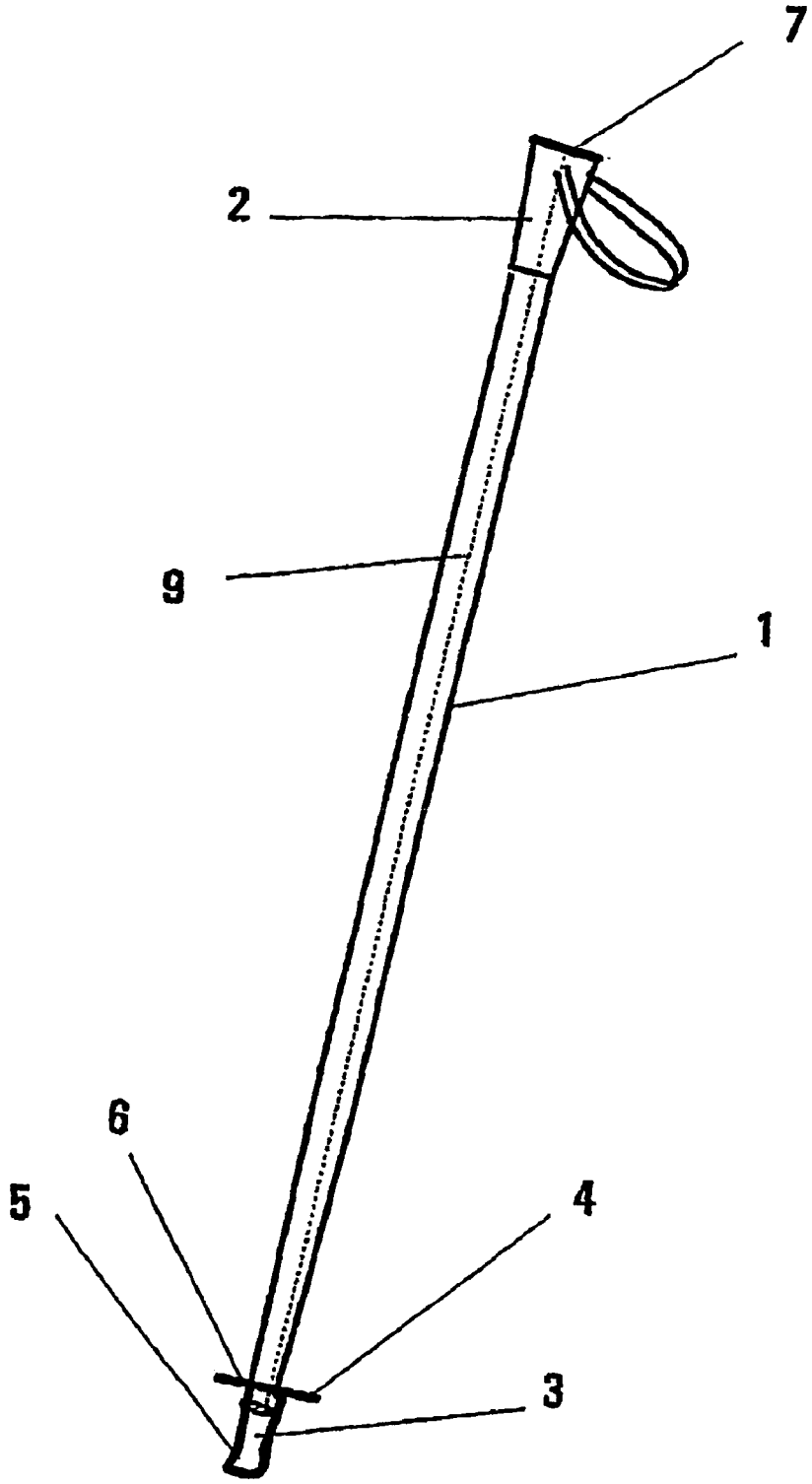
FIG. 1 shows the pole as a whole as seen from the side.

FIG. 1 shows the pole as a whole. It is preferably comprised of a tubular body part 1 or a pole stick, of a grip part 2 attached to one end of the body part, and of a tip part 3 attached to the opposite end. When used as a walking pole, the tubular body part 1 is similar to that used in ski poles, but slightly shorter in length, which makes it preferably suitable for Nordic walking. When the poles are used for exercise with roller skates or skis, the length of the body part 1 of the pole is close to that of a normal ski pole, or even slightly longer. The body part 1 is preferably slightly thinned in the vicinity of the connecting area of the tip part 3.

The tip part 3 is preferably designed to be such that it will not sink too deep into the ground when walking on soft terrain, which would affect the performance of the exercise adversely. This is achieved by means of a widening member 4 corresponding to the ring in a ski pole in the upper part of the tip part 3, and by broadening the part 5 of the tip part coming against the ground, whereby better grip on the walking surface is also obtained. When moving on a hard surface, it is advantageous for the pole to have the type of tip part 3 described above, whereby the tip part made of rubber of plastic will absorb the impact load on the hand when the pole hits the ground. In some cases it may, however, be preferable for the tip part 3 to comprise a spike (not shown in the drawings) resembling the steel tip of a ski pole, whereby maximum grip on the base is obtained. The reduction of impact load can in such a case be done by suspending the pole at the tip 3, in which case the pole will shorten slightly with each thrust due to the suspension and the impact load on the hand is reduced.

To the type of prior art walking or ski pole described above in FIG. 1 is, according to the invention, connected a power sensor 6, which measures, by means of the pole, the force exerted on the ground and its duration during the thrust motion. It further comprises a user interface 7 and a display 8, and means 9 for transmitting data from the power sensor 6 to the display.

The power sensor is preferably located in accordance with FIG. 1 in the tip part 3 of the pole. This is, however, not the only possible solution, but the sensor 6 may be located in any part of the pole, such as in the grip part 2, especially between the grip part and the upper part of the pole stick. What is essential is that from the power sensor 6 is obtained information, which is transmitted by the means 9 to the user interface 7, the data is processed in it, and the results are presented to the user by means of the display 8. The means 9 for transmitting the data may consist of a prior art wireless or wired connection. Since the sensor 6 can be located close to the user interface, an on-line data transmission connection 9 is preferably available.

Figure 2:
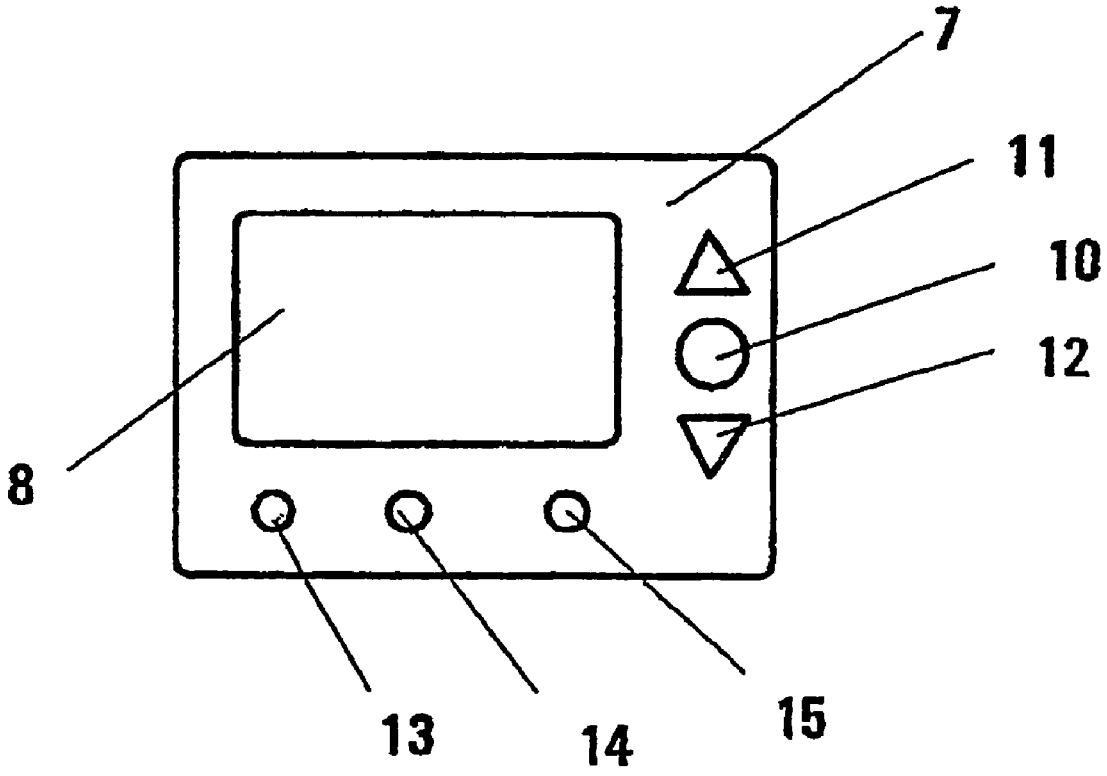
FIG. 2 shows a preferred embodiment of the display on the pole grip and of the user interface as seen from above.

FIG. 2 shows a preferred embodiment of a user interface 7 located preferably in the grip part 2 of the pole, in its upper part, and of a display 8 connected to it. The user interface 7 may also be located on a separate stand (not shown in the drawings), which is fixed by means of an arm to the grip part 2 of the pole or the upper part of the body part 1.

According to the embodiment disclosed, in the following are described in greater detail properties, which the pole according to the invention may, for example, have. An essential aspect from the point of view of the invention is the combination of the pole and the sensor 6, and the transmission of the information obtained by means of this combination to the knowledge of the user in the form of the effect of the exercise performance and the correct manner of performance. The information obtained is in real time and can also be unloaded from the memory afterwards for the purpose of analysing the exercise performance. The memory may be unloaded onto the display 8 or, for example, through a computer connection directly onto a PC.

At the start of an exercise performance, the user interface 7 is used to select a predetermined user profile, or a new profile is determined for a new user. The form of exercise is selected next. The alternatives are exercises taking place in winter (e.g. skiing) or in summer (e.g. pole walking). The form of exercise can be further specified as, for example, exercise taking place in free skiing style in winter.

Points selected next may include, for example, the target number of thrusts per minute, the power level of the thrusts, the duration of a thrust, the total number of thrusts planned to be performed, or the overall time used for the exercise. When the pole is used for Nordic Walking, the length of stride is also selected. The length of the stride and the number of thrusts give the distance travelled.

The selections take place by means of the key buttons 10, 11 and 12 on the user interface 7 shown in FIG. 2, whereby the alternatives for selection are shown on the display 8. The selections may take place, for example, as follows. Key button 10 is used to select the desired parameter and key buttons 11 and 12 are used to change the value of the parameter in the desired direction by a predetermined step. Storing takes place by pressing key button 10 again.

The user interface 7 preferably also comprises one or more warning lights 13 and 14, by means of which the exerciser is informed of the relation of the exercise performance to the set limit values. The user is, for example, warned of a too short duration of the thrust or a too rapid thrust frequency. It is also advantageous to connect a sound signalling device 15 to the warning lights 13 and 14 for drawing the attention of the user. Upper and lower limits for the warnings can be set through the user interface 7.

The operational alternatives of the user interface 7 may include only some of the above alternatives or the interface may include even more possibilities for informing the user.

Figure 3:
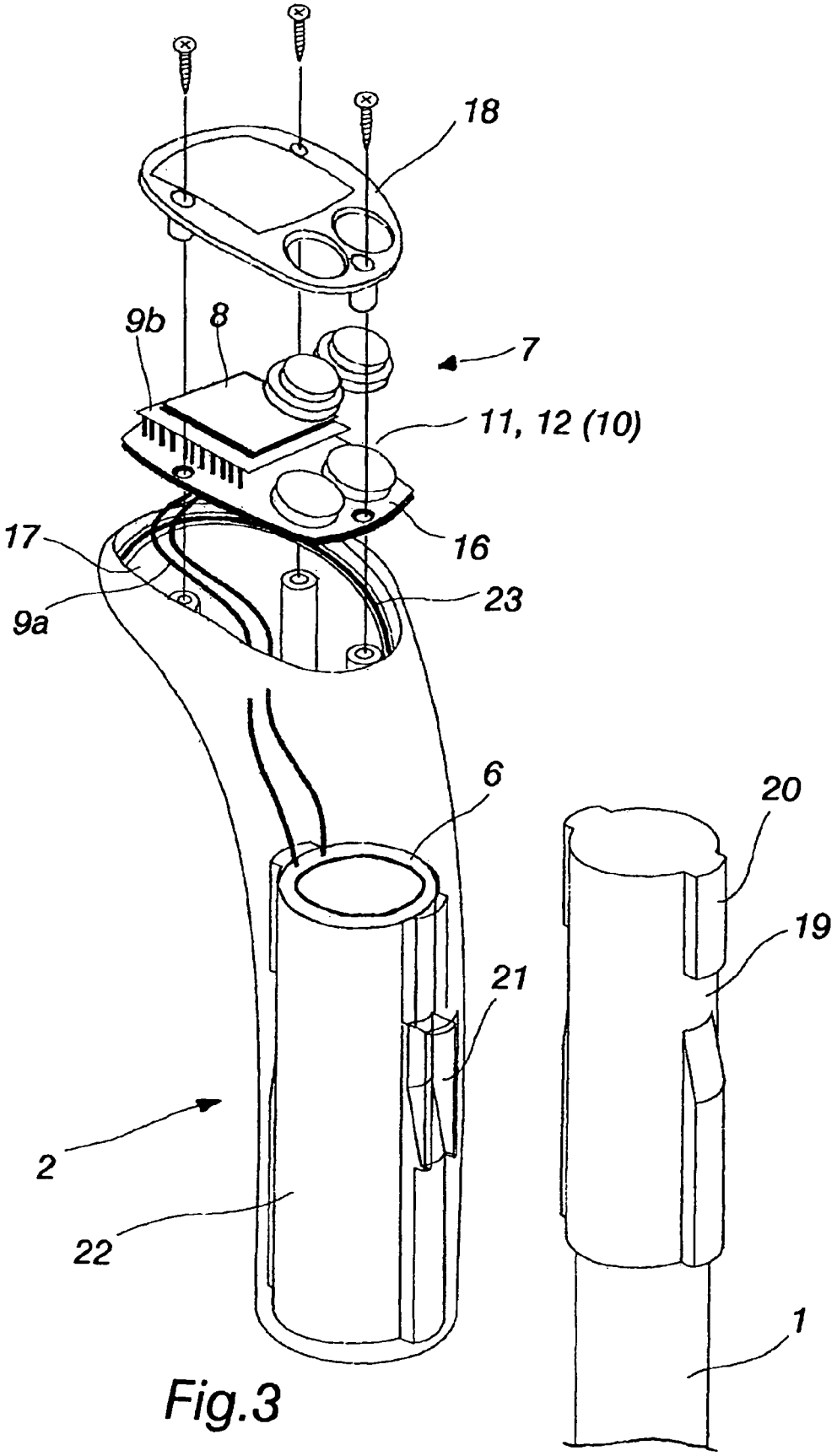
FIG. 3 shows a practical implementation as an exploded view diagonally from above, in which a pressure sensor is located between the grip and the upper part of the pole stick.

FIG. 3 shows a structural embodiment of the invention in greater detail. At the top end of the pole stick 1 is fixed a sleeve member 19, which is injection moulded directly onto the pole tube 1. Inside the grip 2 is a receiving space 22 open from below into which the sleeve member 19 can be pushed. The upper end of the locking tongue 21 grips behind the lower end of the locking protrusion 20. The pressure sensor 6 acting as a power sensor is located between the upper end of the sleeve 19 and the bottom of the recess 22, whereby it measures the axial compressive force between the grip 2 and the body part 1. The pressure sensor 6 is thus located between separate parts which are removably interconnected. The pressure sensor 6 may be, for example, a piezoelectric sensor, or other sensor indicating the compressive force between parts 1 and 2. Between the circuit board 16 and the pressure sensor 6 are data transmission wires 9*a*. The circuit board 16 comprises a microprocessor 9*b* provided with a memory, a display 8 and push-buttons 11, 12 for data transmission. The functions of the previously described push-button 10 may be given to one or both of the push-buttons by pressing it or them both simultaneously for a longer time.

At the top end of the grip 2 is an opening 17 with a washer 23 onto which the circuit board 16 is placed. The circuit board 16 is fixed into place by means of a screwed cover part 18. The cover part 18 is clear at the display, but otherwise matt-finished. The cover part 18 may also include texts indicating the functions of the push-buttons or they may be behind the clear window part of the cover, on the circuit board 16.

Figure 4:
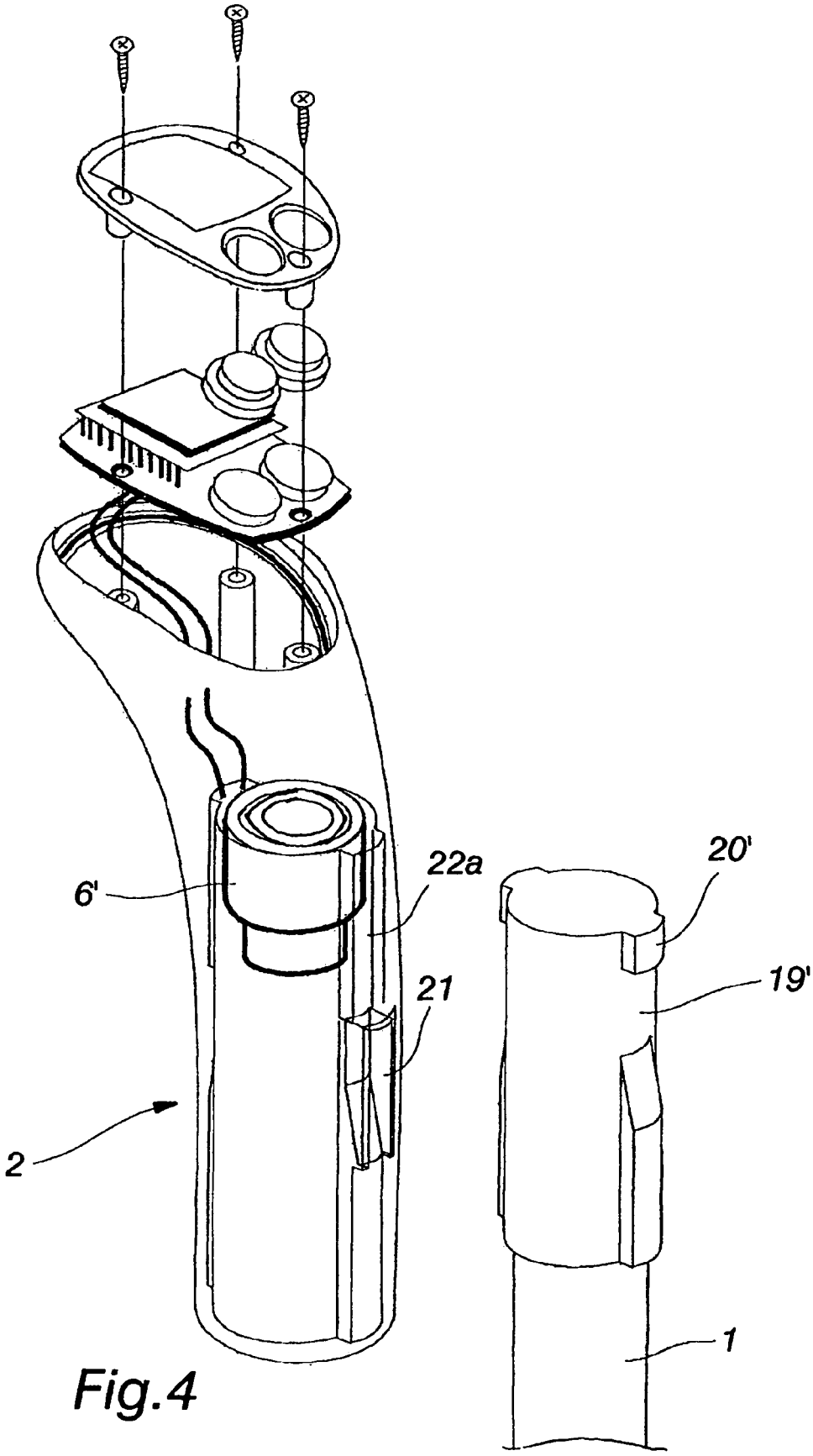
FIG. 4 shows the same as FIG. 3, but with the pressure sensor replaced by a movement sensor.

The embodiment of FIG. 4 differs from that of FIG. 3 only in that the pressure sensor 6 is replaced by a movement sensor 6', which measures the axial movement between the grip part 2 and the body part 1 by means of a capacitive sensor or by optical reading. The grip 2 is maintained in its top position by means of a flexible element belonging to the movement sensor 6', from which position the grip can move with respect to the body part 1 at most some millimetres downwards against the spring force. In this case, the movement sensor 6' acts as a shock absorber at the same time. The sleeve part 19' attached to the upper end of the body tube 1 differs from the sleeve part 19 of FIG. 3 in that the sleeve 19' and also the locking protrusions 20' are shorter, which makes possible the axial movement between the grip 2 and the sleeve 19'. The groove 22*a* above the locking tongue 21 is substantially longer than the protrusion 20'.

A common feature of all embodiments of the invention is that the grip 2 comprises a hand strap, the design of which may vary in many ways.

Since the poles according to the invention are intended to be used in pairs, it suffices for one pole in the pair of poles to be provided with the accessory relating to the invention for controlling the exercise performance. If, however, one wishes to compare the symmetry of working with the poles, both poles are equipped with a device measuring the exercise performance.

The apparatus is preferably battery-operated, but it is conceivable for it to utilise the energy obtained from the exercise performance either partly or completely by applying any known technique.

In the foregoing are merely described some preferred embodiments for implementing the invention. It is, however, obvious to a person skilled in the art that the different embodiments of the invention may vary within the scope of protection presented in the claims. The essential aspect is the combination of a pole, a sensor, a user interface, a display and the means for data transmission for conveying information to the knowledge of the user in real time or for subsequent unloading from the memory for monitoring the effect and correct manner of performing the exercise performance.

The invention claimed is:

1. A pole for pole-assisted exercise, the said pole being comprised of a body part (1), a grip part (2), and a tip part (3), the pole further comprising at least one power sensor (6), a user interface (7) including a display (8) and means (9, 9*a*, 9*b*) for processing the data coming from the power sensor (6) and transmitting it to the display (8), characterised in that the power sensor (6) is located in connection with the grip part (2) or the tip part (3) in such a way that it is located between the said part (2, 3) and the body part (1).

2. A pole as claimed in claim 1, characterised in that the user interface (7) comprises wired data transmission means (9, 9*a*) between the power sensor (6) and the data processing means (9*b*).

3. A pole as claimed in claim 2, characterised in that the user interface (7) comprises means (9*b*, 10, 11, 12) for entering data in the memory, and that the data entered includes limit values set for the exercise performance.

4. A pole as claimed in claim 3, characterised in that the user interface (7) comprises one or more warning lights (13, 14), a sound signalling device (15), or a combination thereof for informing the user of deviations in the exercise performance with respect to the set limit values.

5. A pole as claimed in claim 1, characterised in that as the driving power of the system is used an accumulator/battery, which is arranged to be charged by the energy obtained from the exercise performance.

6. A pole as claimed in claim 1, characterised in that after the exercise, the information on the exercise can be unloaded from the memory onto a display (8), a PC or combination thereof.

7. A pole as claimed in claim 1, characterised in that the information to be entered into the memory by the data entry means (10, 11, 12) includes the length of the stride, and the information to be entered in the memory from the power sensor (6) includes the number of thrusts.

8. A pole as claimed in claim 1, characterised in that at least one of the grip part (2) or tip part (3) are detachable with respect to the body part (1) and re-attachable by means of a quick-release coupling (19, 20, 21).

* * * * *